United States Patent [19]

Zingg et al.

[11] Patent Number: 4,631,755

[45] Date of Patent: Dec. 30, 1986

[54] KNITTED CLOTHING ARTICLE

[75] Inventors: Peter Zingg, Heerbrugg; Werner Mettier, Berneck; Gottfried Lindner, St. Gall, all of Switzerland

[73] Assignee: Rohner Jacob AG, Rebstein, Switzerland

[21] Appl. No.: 715,187

[22] Filed: Mar. 22, 1985

[30] Foreign Application Priority Data

Mar. 27, 1984 [CH] Switzerland ..... 1551/84

[51] Int. Cl.[4] ..... A41B 11/00

[52] U.S. Cl. ..... 2/239; 66/185; 66/202; 66/186

[58] Field of Search ..... 2/239; 66/185, 186, 66/194, 183, 202, 187

[56] References Cited

U.S. PATENT DOCUMENTS 1,686,172 10/1928 Porte ..... 66/194
2,144,563 1/1939 Davis ..... 66/185
4,255,819 3/1981 Klingspor .
4,277,959 7/1981 Thorneburg ..... 66/185
4,373,361 2/1983 Thorneburg ..... 66/186
4,520,635 6/1985 Shields et al. .
4,522,044 6/1985 Lineberry et al. .

FOREIGN PATENT DOCUMENTS 628197 8/1982 Switzerland .
2020958B 7/1982 United Kingdom .

*Primary Examiner*—Ronald Feldbaum
*Attorney, Agent, or Firm*—Karl F. Ross; Herbert Dubno

[57] ABSTRACT

The knitted clothing article has a nonfeltable base mesh layer. On the outside surface of said base mesh layer a yarn layer is knitted in a said base mesh and consisting of feltable textile fibres and forming loop pile meshes. Due to the interaction of the inner base mesh layer with the outer plush layer, a climatic zone is built up that, especially in sports clothing, hosiery and health clothing, assures a good moisture removal and an agreeable body temperature.

6 Claims, 1 Drawing Figure

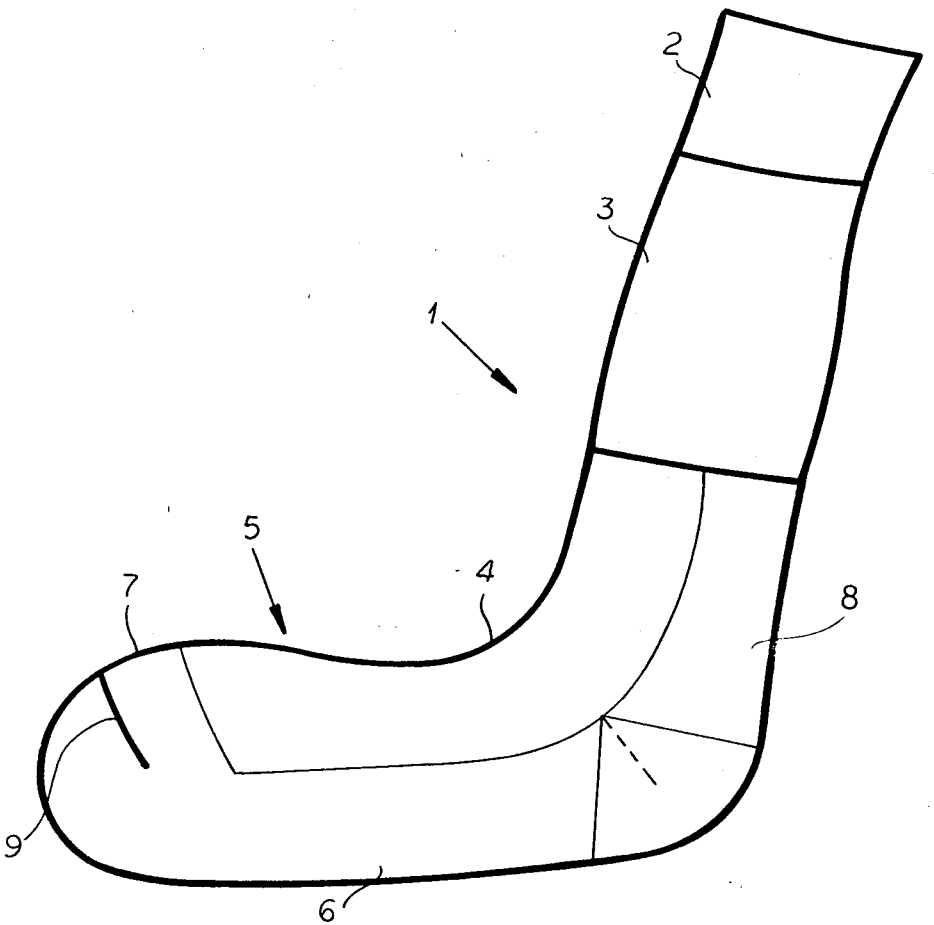
1
2
3
4
5
6
7
8
9

KNITTED CLOTHING ARTICLE

FIELD OF THE INVENTION

The invention concerns a knitted clothing article especially an improved sock or stocking which comprises a base mesh knitted from a non-feltable yarn and a yarn layer is knitted in said base mesh and consisting of feltable textile fibres and forming loop pile meshes.

BACKGROUND OF THE INVENTION

Knitted clothing articles, especially sport socks, are already known, which are fitted with knitted loop-pile meshes to increase their comfort. These loop-pile meshes are placed in the region of the heel, toes or on the whole sole of the sock or stocking and serve first as a soft support for the feet. At the same time they absorbs efficiently perspiration moisture. These loop pile meshes regions give the articles a disturbing look and therfore an untidy appearance. In addition such socks are not hard wearing.

It has already been proposed to overcome these disadvantages by felting the fibers of the yarn knitted into the sole heel and toe regions of a sock or knee stocking. The inner and outer existing layers of matted plush material has, compared with the articles without matting, a better appearance and is harder wearing. This known sock does not satisfy the requirement of absorbing moisture, as the moisture, through a wick-like action, is led upwards where it has to be evaporated through the open weave in the upper part of the foot. For the wicking effect to be effective, the sock in the areas concerned must reach a certain stage of saturation, i.e. a degree of wetness, that is found uncomfortable by the wearer and leads to the unwanted growth of micro-organisms; e.g. athletes foot. Besides which, after a number of wearings, a further matting of the plush material areas is noticed, leading to the stiffening of the sock and a loss of elasticity.

OBJECT OF THE INVENTION

The purpose of the present invention is to provide a sock, or other knitted articles, whose plush material layers, besides being hard wearing and having a soft feel, provide a better and, for the wearer, more satisfactory, means of moisture absorption, i.e. to provide a real measure of comfort.

SUMMARY OF THE INVENTION

All the advantages outlined above are obtained with the improved sock in accordance with the invention. The improvement comprises a base mesh, knitted from a non-feltable yarn, a yarn layer knitted in said base mesh and consisting of feltable textile fibers and forming loop pile meshes, said layer of feltable textile fibers being arranged exclusively on the outside surface of said nonfeltable base mesh away from the body of the wearer.

The method of manufacturing an improved knitted clothing article comprising the steps of knitting a base mesh from a non-feltable yarn, knitting a yarn layer in said base mesh from feltable textile fibers and forming loop pile meshes exclusive on the outside surface of said base mesh, treating said yarn layer of loop pile meshes with a dye containing an alkaline, aniotic surface active medium in order to felt said yarn layer.

The felted loop pile material layer on the outer side of the sock away from the skin of the wearer, together with the inside base mesh layer form a sort of climatic zone which, together with good moisture absorption properties, gives a temperature regulating effect so that the wearer, even with strong sweating, has the feel of dry clothing. It is assumed that in contrast to the wick effect described in U.S. Pat. No. 4,255,819 the unhindered circulation of moisture-saturated air through the base mesh layer on the loose plush material and thence to the outside, allows the moisture disposal and therefor has the observed climatic zone effect. The latter means that, besides keeping the skin dry, the body is kept at a comfortable temperature.

This climatic zone effect is raised when the matted i.e. compressed loop pile material, is made of a wool mixture, preferably of about one third coarse wool, e.g. crossbred wool, and about two thirds fine wool, e.g. Merino wool, which have been mixed in the tuft. Apparently the fine wool is primarily, responsible for the matting and thickening of the matted plush material layer, i.e. the upholstering, and the coarse wool for the permanent elasticity and the air content of the matted plush layers, i.e. the air conditioning, and prevents a possible tendency to further matting and stiffening of the plush layer.

The clothing article can have the matted plush material layer all over the whole of the external portion of the article or only at certain, defined portions of the body. Such portions are for example, for sportswear; shoulders, elbows, buttocks and knees; for hosiery; toes, sole and heel or back and toes. With the application of the invention to hose-soles, the uncomfortable foot burn effect will be avoided.

Plush material-free zones, preferably linear, can be built into the plush material layer which act as canals for the exchange of air; thereby optionizing the climatic zone effect.

BRIEF DESCRIPTION OF THE DRAWING

The invention will be described in greater detail with reference to the accompanying drawing, the sole FIGURE of which is a diagrammatic elevation of a sock.

SPECIFIC DECRIPTION

The sock 1 consists of an edging 2, a leg portion 3, an instep portion 4, and a foot area 5; whereby the latter includes a sole region 6, a toe part 7, and a heel part 8. The sole region 6, the toe part 7 and the heel part 8, consists on their outside surface a layer of feltable textile fibers forming loop pile meshes. This layer forms an elastic element to the inner sole of the shoe on which the foot is elastically supported. Aditionally the formation of moisture or heat, or, in the heel part, the subcooling of the achilles tendon is avoid.

The toe part 7 shows a chain meshed seam 9. The edging 2 is knitted of polyamide sheathed rubber yarn. The leg portion attached to the edging consists of 50% virgin wool and 50% acrylic fiber. The instep portion 4 is smooth and has in accordance with the leg portion 3, a twisted virgin wool/acrylic yarn, and in addition a polyester yarn and a lycra yarn sheathed with Polyamide 6.6. The latter improves the elasticity i.e. the fit of the sock on the foot in the plush material thickened foot area 5. The fitting of the base mesh layer of the foot area 5 corresponds to the instep portion 4, but on the outside it has a wool layer of felted loop pile. The wool portion of the base mesh layer has been knitted from a nonfeltable yarn, so it remains unchanged when the loop pile is felted. Aditionally to the non feltable preparation of the wool portion of the base mesh layer, this portion is treated with a moth protecting agent.

The above mentioned parts of the sock, with the exception of the loop pile material, which must consist essentially of wool, can be varied with a wide range of materials. Especially the wool portions of the leg portion, instep portion and base mesh layer of the foot part can be replaced by cotton or other, even synthetic fibres.

The loop pile material of the mentioned sock were felted in a washing machine in an alkaline Sandopan KD dye bath at 30°–40° C. for 55 minutes.

The invented clothing articles are not specifically intended for sport activities but also in all other areas where similar climatic conditions on the skin are required, e.g. as health clothing or as good quality socks or hose. Inside the plush layer, plush free zones can be left by controlled lifting of the hooks for a distance of, e.g. 1–2 mesh widths. Instead of having plush material at the sole region 6 of a sock the plush material could be placed at the instep portion 4 and the toe part 7. This latter form is especially good for skiers. Naturally a clothing article can be entirely covered on the outside with a plush material layer. The invented comination of felted plush and non felted base mesh layer has the effect, in addition to the upholstery and moisture removal, also temperature compensation, in so far as the air exchange, which can be seen as a form of breathing, is fastened at raised temperatures, which again leads to a faster evaporation and to a cooling effect. A further advantage of the proposed clothing article, especially with hosiery, is that after repeated wearing and washing, no noticeable further matting, and therefore stiffening, of the plush layer appears, so that its softness, fit and climatic zone effect remains over a long period. In addition the proposed clothing article, with its knitted in plush material on the outside, as well as with its inside, presents a closed, clean appearance. At the same time the plush material free inside presents a smooth and therefor pleasant contact surface to the skin.

What we claim is:

1. A sock having a leg portion and a foot portion connected to said leg portion and knitted with a base mesh of a nonfeltable yarn; and a yarn layer knitted in said base mesh of said foot portion over at least a toe, sole and heel region thereof and consisting of feltable textile fibers forming loop pile meshes exclusively on an outside surface of said base mesh, said layer being felted to form a porous mat arranged exclusively on the outside surface of said regions away from the body of the user.

2. The sock defined in claim 1 wherein said yarn layer is formed of a mixed wool of various sizes.

3. The sock defined in claim 1 wherein said yarn layer is composed of yarn consisting of about $\frac{2}{3}$ fine wool and $\frac{1}{3}$ coarse wool.

4. The sock defined in claim 2 wherein the yarn of said yarn layer consists of about $\frac{1}{3}$ cross-bred wool and about $\frac{2}{3}$ merino wool mixed in the tufts.

5. The sock defined in claim 1 wherein said layer is formed in strips between linear zones free from said loop pile meshes.

6. The sock defined in claim 1 wherein said base mesh contains an elasticized fiber.

* * * * *